US006718951B2

(12) United States Patent
Hopley

(10) Patent No.: US 6,718,951 B2
(45) Date of Patent: Apr. 13, 2004

(54) ADVANCE ARRANGEMENT

(75) Inventor: Daniel J Hopley, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 39 days.

(21) Appl. No.: 10/251,012

(22) Filed: Sep. 20, 2002

(65) Prior Publication Data

US 2003/0056766 A1 Mar. 27, 2003

(51) Int. Cl.[7] ..... F02M 37/04
(52) U.S. Cl. ..... 123/502; 123/449
(58) Field of Search ..... 123/449, 502, 123/501, 500, 179.17, 179.16

(56) References Cited

U.S. PATENT DOCUMENTS 4,037,574 A * 7/1977 Swift ..... 123/502
5,188,083 A * 2/1993 Reisser et al. ..... 123/502
5,370,096 A * 12/1994 Cooke ..... 123/502
6,041,759 A * 3/2000 Burborough ..... 123/501
6,363,917 B1 4/2002 Hopley ..... 123/502

* cited by examiner

*Primary Examiner*—Mahmoud Gimie
(74) *Attorney, Agent, or Firm*—David P. Wood

(57) ABSTRACT

An advance arrangement for use in controlling timing of fuel delivery by a fuel pump comprises an advance piston which is moveable within a first bore and which cooperates, in use, with a cam arrangement of a fuel pump to adjust the timing of fuel delivery by the pump. A surface associated with the advance piston is exposed to fuel pressure within an advance piston control chamber. A light load piston is moveable relative to the advance piston against a spring load due to a light load control spring to adjust the timing under light load conditions. A temperature control valve is operable to control fuel pressure applied to the light load piston depending on engine temperature so as to permit adjustment of the timing depending on engine temperature. An adjustment piston co-operates with the light load control spring to vary the spring load acting on the light load piston in response to speed-dependent variations in fuel pressure applied to the adjustment piston, thereby to permit adjustment of the timing depending on engine temperature at relatively low engine speeds.

12 Claims, 3 Drawing Sheets

ADVANCE ARRANGEMENT

FIELD OF THE INVENTION

The invention relates to an advance arrangement for use in controlling the timing of fuel delivery by a high pressure fuel pump intended for use in a compression ignition internal combustion engine.

BACKGROUND OF THE INVENTION

In a conventional rotary fuel pump, the angular position of a cam ring is adjusted by means of a servo-advance arrangement to control the timing of fuel delivery by the pump. The advance arrangement includes an advance piston which is slidable within a bore and which cooperates, in use, with a cam arrangement of the fuel pump to adjust the timing of fuel delivery by the pump. A servo-piston is slidable within a further bore provided in the advance piston and is movable in response to fuel pressure variations within a servo control chamber, the pressure of fuel delivered to the servo control chamber being dependent upon engine speed. If the engine speed increases, fuel pressure delivered to the servo control chamber (transfer pressure) is increased and the servo piston is moved to increase the pressure of fuel applied to the advance piston, thereby causing the advance piston to move to advance the timing of fuel delivery by the pump. If engine speed is reduced, the pressure of fuel delivered to the servo control chamber is reduced causing the servo piston to move to reduce fuel pressure acting on the advance piston, as a result of which timing of fuel delivery is retarded.

It is also known to provide a light load advance arrangement including a light load sensing piston which is movable relative to the advance piston against the action of a light load control spring. A force due to fuel pressure within the light load control chamber acts on the light load piston, in combination with the light load control spring, to determine the relative axial positions of the light load piston and the advance piston and, hence, the maximum permitted level of advance. A control valve is operable to control the pressure of fuel within the light load control chamber depending on the load under which the engine is operating. Thus, depending on the engine load, the pressure of fuel acting on the light load piston varies and the position of the light load piston changes. The movement of the light load piston results in movement of the servo-piston which, in turn, results in movement of the advance piston, thereby causing movement of the cam ring to adjust the timing of fuel delivery by the pump.

It is also known to provide the pump with a cold advance arrangement to permit adjustment of fuel delivery timing depending on engine temperature. The cold advance arrangement includes a temperature control valve arranged to increase fuel pressure within the light load control chamber if the temperature of the engine falls below of predetermined amount. Increased pressure within the light load control chamber results in movement of the light load piston and therefore adjusts the relationship between the position of the advance piston and the temperature of the engine.

For some engines to start and operate properly in cold conditions, it is necessary to advance injection timing to accommodate longer combustion delays. However, it is only possible to adjust the degree of cold advance if transfer pressure is sufficiently high, otherwise the force acting to move of the advance piston to advance timing will be insufficient to overcome the force due to the light load control spring. In conventional pumps, it is only possible to apply cold advance if the engine speed is between idling and rated speed. When conventional pumps of the aforementioned type are used in certain engine applications it is not therefore possible to compensate for cold engine conditions upon engine start up.

It is an object of the present invention to overcome the aforementioned problem.

BRIEF DESCRIPTION OF THE DRAWINGS

Other advantages of the present invention will be readily appreciated as the same becomes better understood by reference to the following detailed description when considered in connection with the accompanying drawings wherein.

Figure 1:
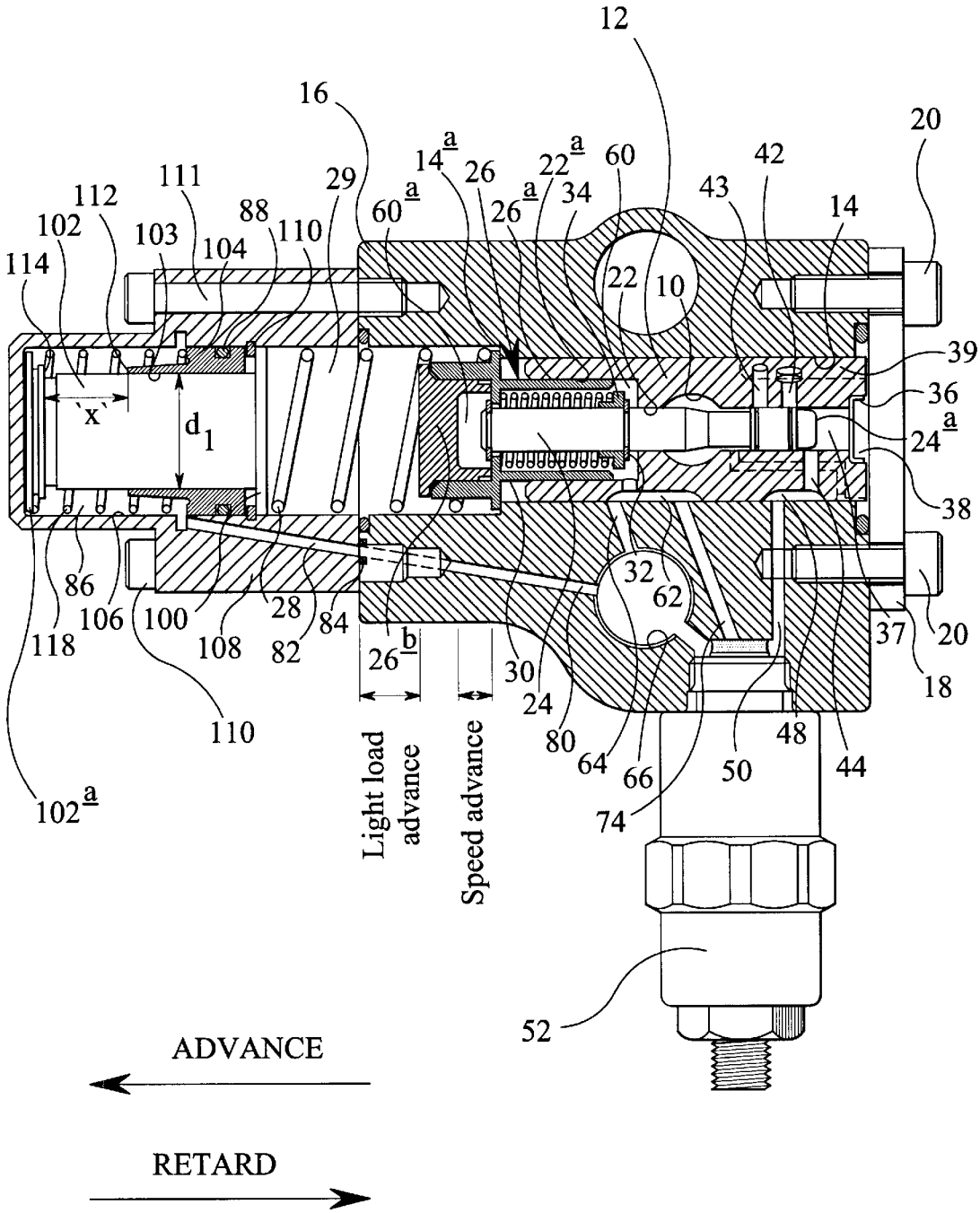
FIG. 1 is a view, part in section, of a part of a fuel pump incorporating an advance arrangement in accordance with a preferred embodiment of the invention in a first position upon engine start-up.

being exposed to fuel pressure within an advance piston control chamber,

SUMMARY OF THE INVENTION

According to the present invention there is provided an advance arrangement for use in controlling timing of fuel delivery by a fuel pump, the advance arrangement comprising;

an advance piston which is moveable within a first bore and which cooperates, in use, with a cam arrangement of a fuel pump to adjust the timing of fuel delivery by the pump, a surface associated with the advance piston being exposed to fuel pressure within an advance piston control chamber, a light load piston moveable relative to the advance piston member against a spring load due to a light load control spring to adjust the timing under light load conditions, a temperature control valve operable to control fuel pressure applied to the light load piston depending on engine temperature so as to permit adjustment of the timing depending on engine temperature, and an adjustment piston which co-operates with the light load control spring to vary the spring load acting on the light load piston in response to speed-dependent variations in fuel pressure applied to the adjustment piston, thereby to permit adjustment of the timing depending on engine temperature at relatively low engine speeds.

The invention preferably includes a speed advance arrangement including a servo-piston which is slidable within a further bore provided in the advance piston to control the pressure of fuel within the advance piston control chamber, a surface associated with the servo-piston being exposed to fuel pressure within a servo control chamber for receiving fuel at transfer pressure.

Upon engine start up, when the engine speed is relatively low and, hence, transfer pressure is low, the adjustment piston is urged, by means of the light load control spring, away from the light load piston to reduce the load of the light load control spring. In circumstances in which the temperature of the engine is low upon engine start-up, it is necessary to advance the timing of injection by moving the advance piston to an advance timing position. For low engine speeds, the advance piston only has to overcome a relatively low spring force due to the adjustment piston being urged to the first position and, thus, it is possible to advance timing of fuel delivery to further compensate for cold engine conditions. As the speed of the engine is increased and transfer pressure increases, the adjustment member is urged towards a second position by increased fuel pressure acting on the adjustment member, under which circumstances the adjustment piston compresses the light load control spring to increase the spring load acting on the light load piston. Beyond idling speed, normal operation of the advance arrangement is therefore resumed.

In a preferred embodiment, a surface associated with the light load piston is exposed to fuel pressure within a light load control chamber such that the position of the light load piston is dependent upon the load under which the engine operates. Typically, a surface of the light load piston itself may be exposed to fuel pressure within the light load control chamber.

Preferably, the adjustment piston is exposed to fuel pressure within a light load adjust control chamber defined by a second bore provided in an advance box housing.

In a preferred embodiment, a sleeve is received within the second bore, the adjustment piston being slidable within the sleeve in response to the speed dependent variations in fuel pressure applied to the adjustment piston.

Preferably, the adjustment piston has an associated surface which is engageable with a stop surface upon movement of the adjustment piston in a direction to increase the load on the light load control spring. For example, the associated surface may be defined by an enlarged end region of the adjustment piston.

The stop surface with which the adjustment piston is engageable may be defined by the sleeve within which the adjustment piston moves.

Preferably, the adjustment member may be arranged to carry an end plate which is engageable with a further stop surface upon movement of the adjustment piston in a direction to relax the light load control spring.

The invention will further be described, by way of example only, with reference to the accompanying drawings in which;

- a temperature control valve operable to control fuel pressure applied to the light load piston depending on engine temperature so as to permit adjustment of the timing depending on engine temperature, and
- an adjustment piston which co-operates with the light load control spring to vary the spring load acting on the light load piston in response to speed-dependent variations in fuel pressure applied to the adjustment piston, thereby to permit adjustment of the timing depending on engine temperature at relatively low engine speeds.

The invention preferably includes a speed advance arrangement including a servo-piston which is slidable within a further bore provided in the advance piston to control the pressure of fuel within the advance piston control chamber, a surface associated with the servo-piston being exposed to fuel pressure within a servo control chamber for receiving fuel at transfer pressure.

Upon engine start up, when the engine speed is relatively low and, hence, transfer pressure is low, the adjustment piston is urged, by means of the light load control spring, away from the light load piston to reduce the load of the light load control spring. In circumstances in which the temperature of the engine is low upon engine start-up, it is necessary to advance the timing of injection by moving the advance piston to an advance timing position. For low engine speeds, the advance piston only has to overcome a relatively low spring force due to the adjustment piston being urged to the first position and, thus, it is possible to advance timing of fuel delivery to further compensate for cold engine conditions. As the speed of the engine is increased and transfer pressure increases, the adjustment member is urged towards a second position by increased fuel pressure acting on the adjustment member, under which circumstances the adjustment piston compresses the light load control spring to increase the spring load acting on the light load piston. Beyond idling speed, normal operation of the advance arrangement is therefore resumed.

In a preferred embodiment, a surface associated with the light load piston is exposed to fuel pressure within a light load control chamber such that the position of the light load piston is dependent upon the load under which the engine operates. Typically, a surface of the light load piston itself may be exposed to fuel pressure within the light load control chamber.

Preferably, the adjustment piston is exposed to fuel pressure within a light load adjust control chamber defined by a second bore provided in an advance box housing.

In a preferred embodiment, a sleeve is received within the second bore, the adjustment piston being slidable within the sleeve in response to the speed dependent variations in fuel pressure applied to the adjustment piston.

Preferably, the adjustment piston has an associated surface which is engageable with a stop surface upon movement of the adjustment piston in a direction to increase the load on the light load control spring. For example, the associated surface may be defined by an enlarged end region of the adjustment piston.

The stop surface with which the adjustment piston is engageable may be defined by the sleeve within which the adjustment piston moves.

Preferably, the adjustment member may be arranged to carry an end plate which is engageable with a further stop surface upon movement of the adjustment piston in a direction to relax the light load control spring.

The invention will further be described, by way of example only, with reference to the accompanying drawings in which;

DETAILED DESCRIPTION OF THE PREFERRED EMBODIMENT

FIG. 1 shows an advance arrangement in accordance with an embodiment of the present invention in which the cam ring is provided with a peg (not shown) which extends into an opening 10 to the cam box provided in an advance piston 12 in order to permit adjustment of the angular position of the cam ring. The advance piston 12 is slidable within a bore 14 provided in a main advance box housing 16. A first end of the bore 14 (to the right in the orientation illustrated) is closed by an end plate 18 which is secured to the advance box housing 16 by means of bolts 20.

The advance piston 12 includes an axially extending bore 22 within which a servo-piston 24 is slidable. The bore 22 is shaped to include an enlarged region 22*a* within which a light load sensing piston 26 is received. The light load piston 26 comprises first and second parts 26*a*, 26*b* respectively. The first part 26*a* includes a region of reduced diameter (to the right in the illustration shown) and a region of enlarged diameter and is provided with a through bore to define an opening through which the servo-piston 24 extends. The second part 26*b* of the light load piston is received within the bore at the end of the first part 26*a* remote from the opening, a region of the second part 26*b* which extends into the bore being provided with a recess which defines, together with a surface of the servo control piston 24, a first region 60*b* of a light load control chamber 60. The light load control chamber 60 also includes a second region 60*a* defined, in part, by the bore 22 in the advance piston 12. The provision of the light load piston 26 provides a means of adjusting the advance characteristic depending upon the load under which the engine operates, as will be described in further detail below.

A spring chamber 29 for a light load control spring 28 is defined, in part, by the bore 14 in the advance box housing 16. The light load control spring 28 is engaged between a surface of the first part 26*b* of the light load piston 26 and an end plate 100 carried by an adjustment piston 102 and is arranged to urge the light load piston 26 into engagement with a step 14*a* defined by part of the bore 14. The adjustment piston 102 is slidable within a through bore 103 of a sleeve member 104 arranged within a blind bore 106 provided in a side advance box housing 108 mounted upon the main advance box housing 16 and secured thereto by means of further bolts 111 (only one of which is fully visible in the section shown). The spring chamber 29 is therefore defined partially by the bore 14 in the advance box housing 16, partially by the bore 106 in the side advance box housing 108 and partially by the plate 110 carried by the adjustment piston 102. The pre-load on the spring 28 which serves to urge the light load piston 26 towards a position in which it engages the step 14*a* in the bore 14 depends upon the extent to which it is compressed and, hence, depends upon the position of the adjustment piston 102 within the bore 106.

The sleeve 104 is held in position within the bore 106 by means of a circlip 110 and defines an abutment or stop surface 112 which is engageable with an associated surface 114 of the adjustment piston 102 upon movement of the adjustment piston 102 within the bore 103 of the sleeve 104 so as to limit the extent of travel of the adjustment piston 102 to the right in the illustration shown in FIG. 1 (referred to as the retard direction). When the adjustment piston is in the fully retarded position in which the surface of the adjustment piston 102 is engaged with the sleeve 104, the pre-load on the light load control spring 28 is at a maximum operational value and, thus, the biasing force acting on the light load piston 26 is at a maximum value.

At the end of the adjustment piston 102 remote from the end plate 100, the piston 102 is shaped to include an end region 102*a* having a diameter greater than the diameter of the piston 102 to define a stepped abutment surface 116 for one end of an adjustment spring 118. The other end of the adjustment spring 118 is engaged with a surface of the sleeve 104, the adjustment spring 118 being arranged to urge the adjustment piston 102 into a fully advanced position in which the end plate 100 carried by the adjustment piston 102 is in engagement with the circlip 110 and the end region 102*a* of the piston 102 is brought near to engagement with the blind end of the bore 106.

A servo control spring 30 is engaged between a surface if the first part 26*a* of the light load piston 26 and an annular member 32 carried by the servo-piston 24. A shim 34 is located between the servo control spring 30 and the annular member 32. The maximum permitted movement of the servo-piston 24 relative to the light load piston 26 occurs when an end surface of the servo-piston 24 is moved into engagement with the recess provided in the second part 26*b* of the light load piston 26. Movement of the servo-piston 24 relative to the advance piston 12 is limited by engagement between the annular member 32 and a part of the bore 22 provided in the advance piston 12.

At the end of the bore 22 remote from the light load piston 26, a disc-shaped member 36 is arranged within an annular groove provided in the advance piston 12. The disc-shaped member 36 defines, together with a part of the bore 22 provided in the advance piston 12, a servo control chamber 37 for receiving fuel, a force due to fuel pressure within the servo control chamber 37 acting on an end surface 24*a* of the servo-piston 24 so as to urge the servo-piston 24 towards the left in the illustration shown in FIG. 1 against the force due to the servo control spring 30. Fuel at transfer pressure is delivered to the servo control chamber 37 through a servo supply passage 50 provided in the advance box housing 16, as will be described in further detail below. The pressure of fuel within the servo control chamber 37 is referred to as "servo control pressure", the servo control pressure being dependent upon the speed at which the engine operates.

An advance piston control chamber 38 is defined by an end face of the advance piston 12 remote from the light load piston 26, the associated part of the bore 14, a surface of the disc-shaped member 36 and the end plate 18*a*. The advance piston control chamber 38 communicates, via a channel 39 formed in the outer periphery of the advance piston 12, with a radially extending fill passage 42 provided in the advance piston 12. The advance piston control chamber 38 also communicates through the channel 39 with a drain passage 43 provided in the advance piston 12 which, depending on the position of the servo-piston 24 within the bore 22, may be able to communicate with the opening 10 to the cam box. Typically, the cam box is at relatively low pressure, commonly referred to as "cam box pressure".

The advance piston is also provided with a delivery passage 44 defined partially by a radially extending drilling and partially by a recess 48 provided in the outer surface of the advance piston 12, the recess 48 being located so that for all permitted positions of the advance piston 12 relative to the advance box housing 16, the recess 48 communicates with the servo supply passage 50. In use, upon an increase in transfer pressure due to an increase in engine speed, fuel pressure within the servo control chamber 37 is increased. The force acting on the end surface 24*a* of the servo-piston 24 is therefore increased causing the servo-piston 24 to be urged to the left in the illustration shown, thereby bringing the servo control chamber 37 into communication with the fill passage 42 and permitting fuel to flow into the advance piston control chamber 38. Increased fuel pressure within the advance piston control chamber 38 serves to urge the advance piston 12 to the left in the illustration shown (an advance direction), increasing the volume of the advance piston control chamber 38 and causing the timing of fuel delivery by the pump to be advanced.

If fuel pressure in the servo control chamber 37 is reduced as result of a reduction in transfer pressure, the force acting on the end surface 24*a* of the servo-piston 24 is reduced and the servo-piston 24 is urged to the right in the illustration shown due to the force of the servo control spring 30. A point will be reached at which communication between the fill passage 42 and the servo control chamber 37 is broken by the outer surface of the servo piston 24 and, subsequently, communication between the drain passage 43 and the opening 10 to the cam box is opened. Thus, depending on the position of the servo-piston 24 within the bore 22, the advance piston control chamber 38 either communicates with the servo control chamber 37 through the fill passage 42, or through the drain passage 43 with the opening 10 in the advance piston 12 at cam box pressure.

The position of the servo control piston 24 within the bore 22 is adjusted in response to pressure variations in the light load control chamber 60 depending upon the load under which the engine operates. The region 60*a* of the light load control chamber 60 is in communication with an additional recess 62 provided in the outer surface of the advance piston 12. The additional recess 62 is arranged such that, for all permitted positions of the advance piston 12, it communicates with a light load supply passage 64. The light load supply passage 64 communicates with a bore 66 provided in the advance box housing 16 such that fuel can be delivered to the light load control chamber 60.

In conditions in which the engine is operating at a relatively light load, the pressure of fuel within the light load control chamber 60 is relatively high and the light load piston 26 is therefore urged out of engagement with the step 14*a*, against the force due to the light load spring 28, in the advance direction. Such movement of the light load piston member 26 reduces the compression of the servo control spring 30, thereby permitting the servo-piston 24 to move in the advance direction under the influence of fuel pressure in the servo control chamber 37. The movement of the servo-piston 24 permits fuel to flow to the advance piston control chamber 38 from the servo-control chamber 37, resulting in movement of the advance piston 12 to advance the timing of fuel delivery by the pump, as described previously.

If the engine is operating under a relatively high load, fuel pressure within the light load control chamber 60 is reduced, in which case the light load piston 26 is urged to the right in the illustration shown, moving the light load piston 26 into engagement with the step 14*a*. With the light load piston 26 in this position, the servo control spring 30 is compressed to increase the spring load acting on the servo piston 24 which must be overcome if the servo piston 24, and hence the advance piston 12, is to move in the advance timing direction. The maximum extent of movement of the servo piston 24 is also reduced in such circumstances and, hence, the maximum permitted extent of movement of the advance piston 12 in the advance direction is reduced. Thus, the light load advance arrangement permits the advance characteristic to be varied, depending on the load under which the engine is operating.

Depending on the axial position of the advance piston 12, the additional recess 62 provided on the outer surface of the advance piston 12 may also communicate with a cold advance supply passage 74 defined in the advance box housing 16, an electro-magnetically operated temperature control valve 52 being mounted upon the cam box housing 16 to control the supply of fuel through the cold advance supply passage 74. Typically, the temperature control valve 52 takes the form of a conventional stop solenoid which is supplied with electrical current only when the engine is at a relatively low temperature. The temperature control valve 52 is therefore only in an open position when the engine is cold, in which circumstances fuel pressure within the light load control chamber 60 is increased independently of any fuel pressure variation due to the load under which the engine is operating. The provision of the temperature control valve 52 provides a means of advancing the timing of fuel delivery in the event that engine temperature falls below a predetermined amount. Further details of the operation of such a cold advance arrangement can be found in our co-pending European patent application EP 0921 300 A.

The advance box housing 16 is also provided with a further supply passage 80 which is supplied with fuel at transfer pressure. The further supply passage 80 communicates with an additional supply passage 82 provided in the side advance box housing 108, an O-ring 84 being provided at the point of interconnection of the two passages 80, 82 to provide a substantially fluid tight seal between the adjacent housings 16, 108. Fuel is delivered through the supply passages 80, 82 to a light load adjust control chamber 86 defined at the blind end of the bore 106. Fuel delivered to the light load adjust control chamber 86 applies a force to an end face of the end region 102*a* of the adjustment piston 102 which serves to urge the adjustment piston 102 to the right in the illustration shown, thereby increasing the load on the adjustment spring 118. A further O-ring 88 is arranged within the bore 106 to ensure a substantially fluid tight seal exists between the light load adjust control chamber 86 and the spring chamber 29.

It will be appreciated that the load on the light load control spring 28 which acts on the light load piston 26 to bias the first part 26*a* of the light load piston 26 into engagement with the step 14*a* will be determined by the position of the adjustment piston 102 within the light load adjust control chamber 86. Thus, the extent to which the light load piston 26 is advanced for a given engine load will depend upon the pressure of fuel within the light load adjust control chamber 86 which, in turn, is determined by the speed at which the engine operates.

The pressure of fuel delivered to the light load adjust control chamber 86 is relatively low upon engine start-up. The force acting on the adjustment piston 102 due to fuel pressure within the light load adjust control chamber 86 is therefore relatively low and is insufficient to overcome the force due to the adjustment spring 118 acting on the adjustment piston 102 in the opposite direction. In such circumstances, the adjustment piston 102 is urged, by means of the adjustment spring 118, into a position of advance (as shown in FIG. 1) in which the end plate 100 carried by the adjustment piston 102 is in engagement with the circlip 110 and in which the end region 102*a* of the adjustment piston 102 is brought near to engagement with the blind end of the bore 106. It will be appreciated that, with the adjustment piston 102 in the position shown in FIG. 1, the pre-load on the light load control spring 28 is relatively low.

Initially, following engine start-up, fuel pressure within the servo control chamber 37 is relatively low, in which case the servo-piston 24 is urged into the position shown in FIG. 1 by means of the servo control spring 30. With the servo-piston 24 in this position, fuel within the servo control chamber 37 is unable to flow through the radially extending passage 42 into the advance piston control chamber 38 and the position of the advance piston 12 within the bore 14 is not advanced.

As the speed of rotation of the engine increases, resulting in an increase in transfer pressure, fuel pressure supplied to the servo control chamber 37 is increased. An increased force is therefore applied to the end surface 24*a* of the servo-piston 24 which serves to urge the servo-piston 24, against the action of the servo control spring 30, to a position in which communication between the servo control chamber 37 and the fill passage 42 is permitted. In such circumstances, fuel flows from the servo control chamber 37, through the fill passage 42 into the advance piston control chamber 38. The flow of fuel to the advance piston control chamber 38 increases fuel pressure therein, applying a force to the advance piston 12 to increase the volume of the advance piston control chamber 38 and causing the advance piston 12 to move to the left in the orientation illustrated in FIG. 1 to advance the timing. Movement of the servo piston 24 is initiated upon an increase in fuel pressure within the servo control chamber 37, even in circumstances in which fuel pressure within the servo control chamber 37 is still relatively low (e.g. when transfer pressure is low upon engine start-up), as only a relatively low force is required to overcome the reduced pre-load of the light load control spring 28 if the adjustment piston 102 is in the fully advanced position. This is particularly important if the temperature of the engine is low, such as is often the case when the engine is started. In such circumstances the temperature control valve 52 is activated such that fuel at transfer pressure is able to flow through the temperature control valve 52 into the cold advance supply passage 74, therefore increasing further fuel pressure within the light load control chamber, the purpose of which is to advance the position of the advance piston 12, to advance the timing of fuel delivery so as to accommodate the longer combustion delays at low engine temperature. The present invention therefore provides the advantage that, even for low engine speeds (e.g. upon engine start-up) when the temperature of the engine is low, the timing can be advanced by the cold advance arrangement.

As described previously, as transfer pressure is relatively low upon engine start-up, the force acting on the end face of the end region 102*a* of the adjustment piston 102 is insufficient to urge the adjustment piston 102 in the retard direction, such that the servo control spring 28 is in a relaxed condition (as shown in FIG. 1) in which the pre-load of the spring 28 is low. As engine speed increases, the pressure of fuel delivered to the light load adjust control chamber 86 will be increased and a point will be reached at which the force acting on the end face of the adjustment piston 102 is sufficient to overcome the force due to the adjustment spring 118, thereby serving to urge the adjustment piston 102 into the position shown in FIG. 2 (a retarded position) in which the pre-load of the servo control spring 28 is increased. The maximum permitted movement of the adjustment piston 102 is represented by distance "X" in FIG. 1.

The characteristics of the servo control spring 28 are selected to ensure the desired light load adjustment characteristics during normal engine operating conditions above idling speed are achieved in circumstances in which the adjustment piston 102 is retarded through the distance X and the light load control spring 28 is fully compressed. Thus, when operating conditions are normal, the engine is hot and the temperature control valve 52 is switched so that a metered flow of fuel at transfer pressure is supplied into the light load supply passage 64, but is not supplied to the cold advance supply passage 74, the required relationship between engine speed and the degree of advance is obtained. It is only when fuel pressure within the light load adjust control chamber 86 is relatively low, and the adjustment piston 102 adopts a fully advanced position to permit relaxation of the spring 28, that any speed-dependent adjustment is made to the position of the light load piston 26.

Figure 2:
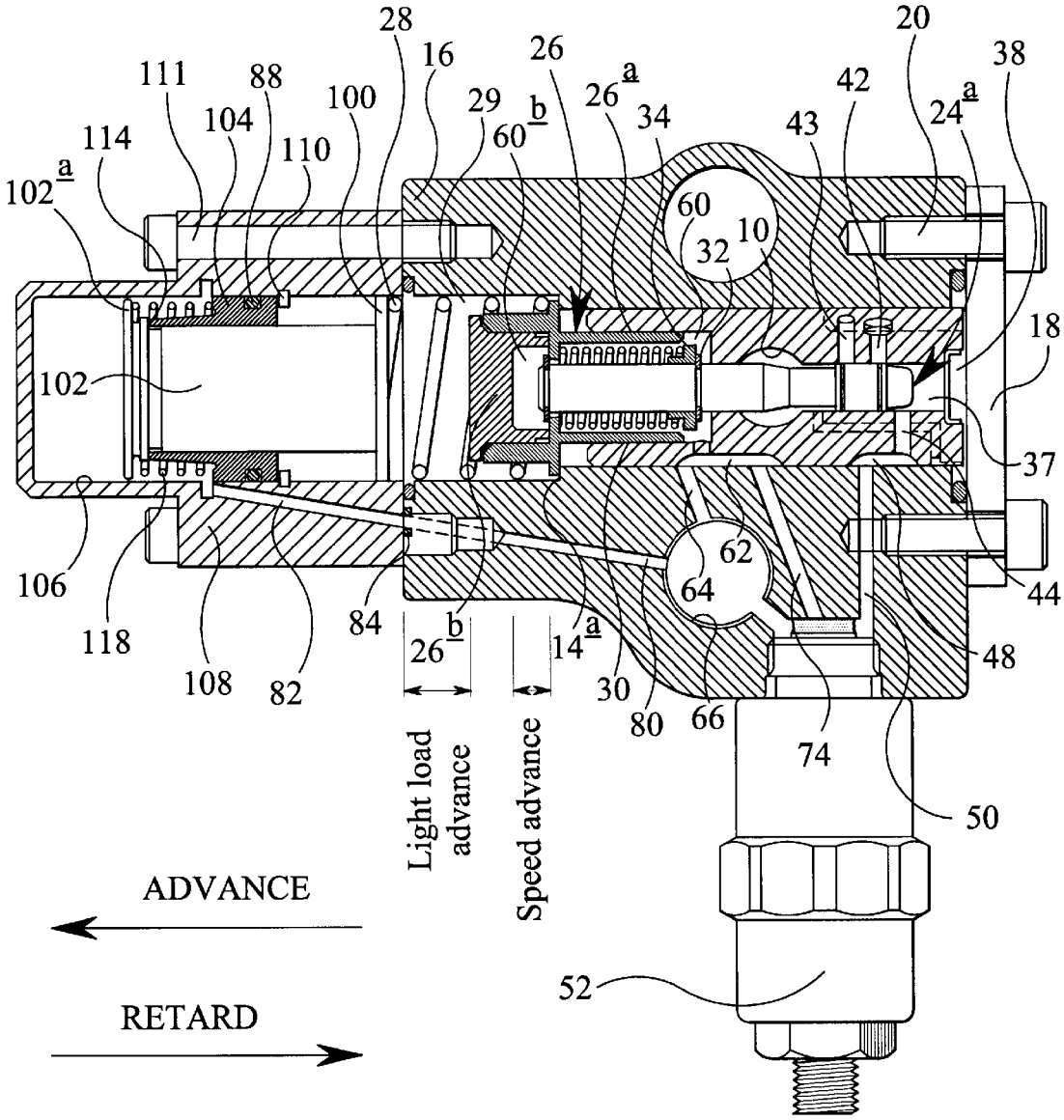
FIG. 2 is a view, part in section of the advance arrangement in FIG. 1 when in a second position when the engine is operating above idling speed.

It is important that the adjustment piston 102 has a diameter, d1, greater than the diameter of the light load piston 26 of the bore region 22*a* to ensure the adjustment piston 102 can be retained in the fully retarded position shown in FIG. 2 even under light load conditions.

The invention provides an advantage over known advance arrangements provided with a cold advance scheme as it is possible to control the level of cold advance at engine speeds below idling speed. It is particularly important to be able to provide additional cold advance at engine start-up when the temperature of the engine is low, so as to accommodate longer combustion delays. If insufficient timing advance is provided on engine start-up, the engine may start and will begin to accelerate, but operation may terminate before enough heat has been absorbed to sustain operation. Using conventional advance arrangements it is only possible to provide cold advance between idling speed and a rated engine speed. The present invention provides the further advantage that, once the engine has been started and is operating at a normal operating speed, the load on the light load control spring 28 is restored to the predetermined level to provide the desired light load characteristics for normal operating conditions.

Figure 3:
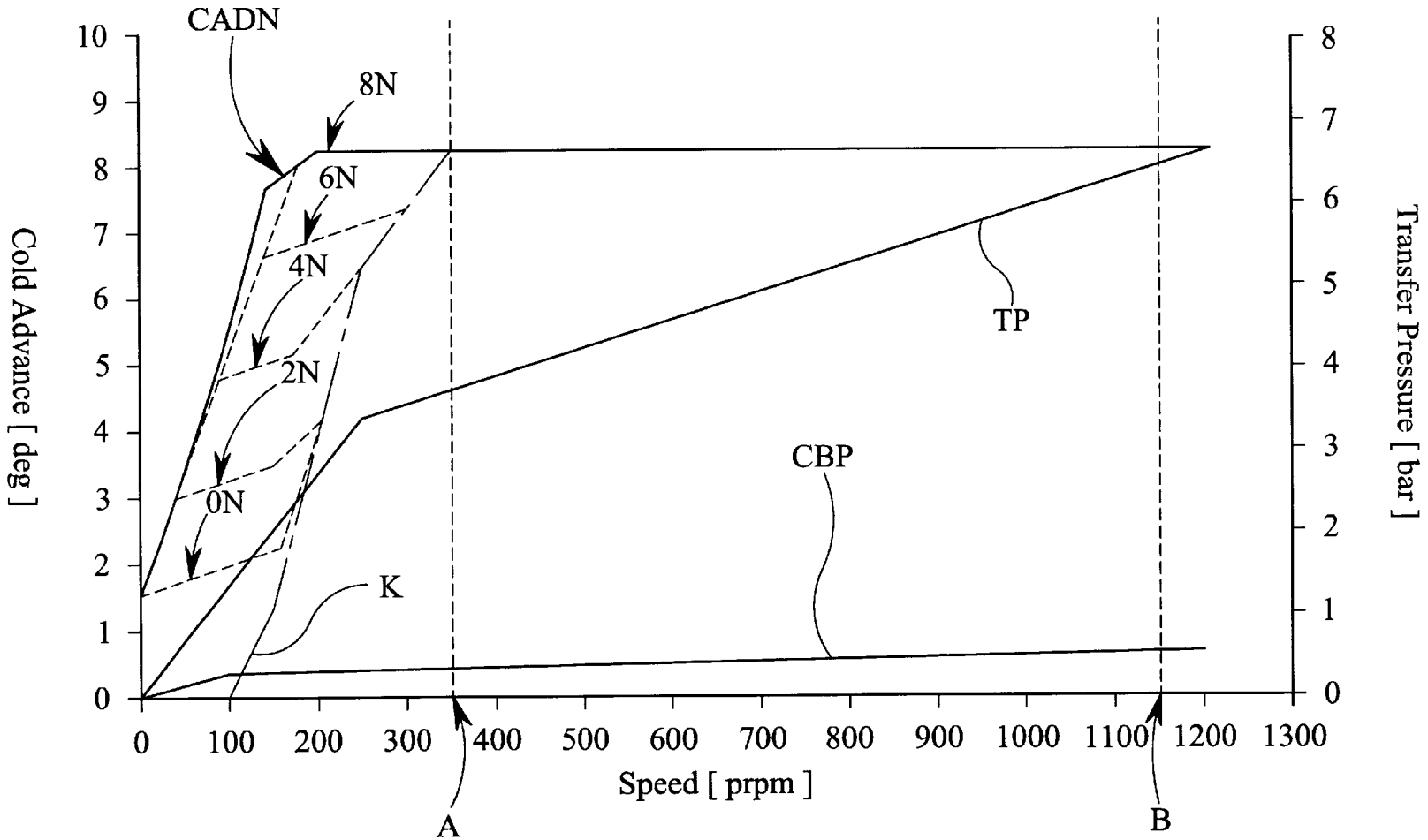
FIG. 3 is graph to illustrate operational characteristics of the advance arrangement in FIGS. 1 and 2 as a function of engine speed and adjustment spring pre-load.

FIG. 3 illustrates the degree of cold advance (i.e. the extent to which the advance piston is advanced in response to the temperature of the engine falling below a predetermined temperature) as a function of engine speed. Typical engine idling and rated speeds are identified at A and B respectively. The curve identified as "CBP" represents cam-box pressure (units on right hand y-axis) and the curve identified as "TP" represents transfer pressure, each of which is illustrated as a function of speed. Curve "CADV" represents the degree of cold advance for increasing engine speed for a pre-load on the adjustment spring 118 of 8 N. The degree of cold advance for various pre-loads on the adjustment spring 118 is also shown in dashed lines ranging from a spring pre-load of 0N to 6N. It can be seen from FIG. 3 that it is possible to provide cold advance even if the engine speed is relatively low, for example less than 100 PRPM (pump revolutions per minute).

The curve labelled "K" in FIG. 3 represents the degree of cold advance for a standard advance arrangement including a cold advance scheme, but in which no means for adjusting the pre-load on the light load control spring 28 is provided. In this case, it is not possible to provide cold advance at engine speeds below 100 PRPM.

In the present invention, it is that the cold advance characteristics of the arrangement are recovered before the engine reaches idling speed. In other words, when the adjustment piston 102 is urged into the position shown in FIG. 2, the CADV curve must intercept, and beyond a certain engine speed follow, the cold advance characteristic curve (K) for the conventional advance arrangement without a light load spring adjust scheme. Therefore it is not appropriate to use a spring 118 having a pre-load of 8N for an engine having the characteristics shown in FIG. 3.

The advance arrangement having a light load spring adjust scheme described herein before may be used in a fuel pump of the type in which pumping plungers move in a radial direction in order to supply fuel at high pressure to an engine. It will be appreciated, however, that the advance arrangement may also be applicable to other types of high pressure fuel pump in which it is a requirement to adjust the timing of fuel delivery by the pump for relatively low engine temperatures.

What is claimed is:

1. An advance arrangement for use in controlling timing of fuel delivery by a fuel pump, the advance arrangement comprising;

an advance piston which is moveable within a first bore and which cooperates, in use, with a cam arrangement of the fuel pump to adjust the timing of fuel delivery by the pump, a surface associated with the advance piston being exposed to fuel pressure within an advance piston control chamber, a light load piston moveable relative to the advance piston against a spring load due to a light load control spring to permit adjustment of the timing under light load conditions, a temperature control valve operable to control fuel pressure applied to the light load piston depending on engine temperature so as to permit adjustment of the timing depending on engine temperature, and an adjustment piston which co-operates with the light load control spring to vary the spring load acting on the light load piston in response to speed-dependent variations in fuel pressure applied to the adjustment piston, thereby to permit adjustment of the timing depending on engine temperature at relatively low engine speeds.

2. The advance arrangement as claimed in claim 1, comprising a servo-piston which is slidable within a bore provided in the advance piston to control the pressure of fuel within the advance piston control chamber, a surface associated with the servo-piston being exposed to fuel pressure within a servo control chamber.

3. The advance arrangement as claimed in claim 2, wherein a surface associated with the light load piston is exposed to fuel pressure within a light load control chamber, wherein fuel pressure within the light load control chamber is dependent upon the load under which the engine operates, such that the position of the light load piston is dependent upon said engine load.

4. The advance arrangement as claimed in claim 1, wherein the adjustment piston is exposed to fuel pressure within a light load adjust control chamber defined by a second bore provided in an advance box housing.

5. The advance arrangement as claimed in claim 4, wherein a sleeve is received within the second bore, the adjustment piston being slidable within the sleeve in response to the speed-dependent variations in fuel pressure applied to the adjustment piston.

6. The advance arrangement as claimed in claim 5, wherein the adjustment piston has an associated surface which is engageable with a stop surface upon movement of the adjustment piston in a direction to increase the load on the light load control spring.

7. The advance arrangement as claimed in claim 5, wherein the associated surface is defined by an enlarged end region of the adjustment piston.

8. The advance arrangement as claimed in claim 6, wherein the associated surface is defined by a enlarged end region of the adjustment piston.

9. The advance arrangement as claimed in claim 6, wherein the stop surface is defined by the sleeve within which the adjustment piston moves.

10. The advance arrangement as claimed in claim 1, wherein the adjustment member carries an end plate which is engageable with a further stop surface upon movement of the adjustment piston in a direction to relax the light load control spring.

11. An advance arrangement for use in controlling timing of fuel delivery by a fuel pump, the advance arrangement comprising:

an advance piston which co-operates, in use, with a cam arrangement of the fuel pump to adjust the timing of fuel delivery by the pump, a surface associated with the advance piston being exposed to fuel pressure within an advance piston control chamber, a light load piston moveable relative to the advance piston in response to fuel pressure variations within a light load control chamber, against a light load control spring, to permit adjustment of the timing under light load conditions, a temperature control valve operable to control fuel pressure applied to the light load piston in dependence upon engine temperature, and an adjustment piston which is slidable within a sleeve in response to speed-dependent variations in fuel pressure applied thereto to vary the light load control spring force acting on the light load piston, thereby to permit adjustment of the timing in dependence on engine temperature, even at relatively low engine speeds.

12. The advance arrangement as claimed in claim 11, wherein the adjustment piston has an end region which is engageable with the sleeve upon movement of the adjustment piston in a direction to increase the light load control spring force.

* * * * *